US005628485A

United States Patent [19]

Ray

[11] Patent Number: 5,628,485

[45] Date of Patent: May 13, 1997

[54] DRINK HOLDER

[76] Inventor: Cheryl G. Ray, 461 Green Glade Rd., Birmingham, Ala. 35244

[21] Appl. No.: 357,198

[22] Filed: Dec. 13, 1994

[51] Int. Cl.[6] ..... A47B 96/06

[52] U.S. Cl. ..... 248/231.61; 248/230.5; 248/311.2

[58] Field of Search ..... 248/311.2, 214, 248/205.2, 230.5, 231.85, 230.8, 230.4, 229.13, 230.3, 231.51, 231.61; 297/188.2

[56] References Cited

U.S. PATENT DOCUMENTS

| | | | |
|---|---|---|---|
| 3,131,842 | 5/1964 | Dingle, Jr. et al. | 248/311.2 X |
| 3,452,976 | 7/1969 | Ross | 248/229.13 X |
| 3,784,140 | 1/1974 | Averbach | 248/230.4 X |
| 4,310,193 | 1/1982 | Kolleas | 245/220.43 X |
| 4,530,479 | 7/1985 | Chen . | |
| 4,535,921 | 8/1985 | Sanders | 248/311.2 X |
| 4,596,370 | 6/1986 | Adkins . | |
| 4,712,313 | 12/1987 | Gettleman | 248/205.2 X |
| 4,728,147 | 3/1988 | Dutton | 248/230.8 X |
| 5,007,612 | 4/1991 | Manfre | 248/311.2 X |
| 5,054,729 | 10/1991 | Mogi | 248/231.85 X |
| 5,106,046 | 4/1992 | Rowles et al. . | |
| 5,143,335 | 9/1992 | Frankel | 248/311.2 X |
| 5,199,678 | 4/1993 | Luebke | 248/214 X |
| 5,249,770 | 10/1993 | Louthan | 248/311.2 |
| 5,279,452 | 1/1994 | Huynh . | |
| 5,295,650 | 3/1994 | Brandt | 248/311.2 |

FOREIGN PATENT DOCUMENTS

| | | |
|---|---|---|
| 660448 | 4/1987 | Switzerland . |
| 579356 | 7/1946 | United Kingdom . |
| 2223931 | 4/1990 | United Kingdom . |

*Primary Examiner*—Derek J. Berger
*Attorney, Agent, or Firm*—Richard C. Litman

[57] ABSTRACT

An insulated drink holder attachable to a lawn chair or the like. The drink holder includes a receptacle for holding a beverage container, and a two part clamp attached to the receptacle. One side of the clamp is formed by an arm projecting laterally from the receptacle. In alternative embodiments, the other side of the clamp comprises a member adjusted in discrete steps by a peg and socket arrangement, or a spring urged jaw pivotally mounted to the arm. Resilient cushions are located on the upper and lower sides of the clamp to conform to the lawn chair frame being grasped, and to prevent the drink holder from gimballing. In both embodiments, flexible straps bearing hook and loop fastener are tightened around the clamp to further improve grip. The novel drink holder cooperates with lawn furniture having either tubular or square channel frame members.

3 Claims, 2 Drawing Sheets

DRINK HOLDER

BACKGROUND OF THE INVENTION

1. Field of the Invention

The present invention relates to a holder for supporting beverage containers such as cups, glasses, and cans. A receptacle receives the container, and a clamp engages a nearby environmental object, such as a lawn chair. A strap having hook and loop material secures the clamp tightly in place.

2. Description of the Prior Art

Beverages contained within drinking glasses, cans, and the like are frequently enjoyed by persons who are engaged in activities such as driving, or sunbathing or other diversions wherein they are seated in a lawn chair or the like. It is desirable to locate the beverage receptacle close at hand for convenience and to assist in preventing spills. Accordingly, holders for supporting drinking glasses and cans attached to a chair, automobile door, and similar environments have been developed to meet this need.

U.S. Pat. No. 4,728,147, issued to Ronald W. Dutton on Mar. 1, 1988, describes a drink holder intended for attachment to a lawn chair. The drink holder comprises an open frame to support the beverage container. The holder secures to the lawn chair by partial surrounding engagement of a frame member of the lawn chair with a portion of the body of the holder. A flexible strap of hook and loop material completes the encirclement. The portion of the body designed to engage the lawn chair has a square walled recess, and is substantially limited to use with lawn chairs having frames cooperating in dimension and configuration with this recess.

U.S. Pat. Nos. 5,106,046, issued to Donald R. Rowles et al. on Apr. 21, 1992, and U.S. Pat. No. 5,279,452, issued to Nichol Huynh on Jan. 18, 1994, describe drink holders intended for use in automobiles. Both include a tab insertable into the gap existing between a window and its adjacent door structure. The tab projects downwardly, and the inner portion of the door structure is straddled by the tab and an arm connecting the tab to the body of the drink holder. No flexible straps are employed to secure the installation. The receptacle of the device of Huynh is provided by an insulating blanket. The receptacle of the Rowles et al. holder is an open frame similar to that of Dutton.

In U.S. Pat. No. 5,249,770, issued to Connie S. Louthan on Oct. 5, 1993, a drink holder comprising an open frame is secured to an adjacent environmental object in one of two ways. The body of the holder is provided with many slots for accepting a belt covered with hook and loop fastener. The belt can be passed through any of the slots in several different ways, so that attachment can be pendant, or attachment may be by drawing the holder into tight abutment with the environmental object. Pendant attachment may possibly be subject to allowing a drink so supported to sway and spill. Abutment with a flat vertical surface will likely suppress swaying, but attachment may not be readily accomplished. In the case of lawn chairs and the like typically comprising tubular frames, there is no flat surface to suppress sway. Therefore, while the holder may be tightly and solidly mounted to its supporting environmental object, spillage is possible in a great many instances.

U.S. Pat. No. 4,596,370, issued to George H. Adkins on Jun. 24, 1986, sets forth a drink holder intended for use with bicycles. A clamp having circular recesses is tightened around a tubular member of the bicycle. Securement of the clamp is accomplished by tightening a wing nut onto a threaded stud. There is no hook and loop strap provided. The receptacle surrounding the beverage container comprises a sleeve of fairly rigid material lined with an insulating material.

U.K. Pat. No. 579,356, dated Jul. 31, 1946, illustrates a spring urged clamp for securing a holder or support to an associated environmental object. The support or holder comprises a clothes pin adapted so that the wire bent to form the spring is elongated, projecting laterally from the clothes pin, and bent to define loops into which a beverage container may be placed. The clothes pin clamps to a small, cylindrical object in order to support the portion of the wire bent to form the receptacle. Obviously, an extensive receptacle cooperating with a beverage container would not be provided by the wire loops. No insulating member could readily be formed to cooperate with the receptacle.

U.S. Pat. No. 54,530,479, issued to Jason K. Chen on Jul. 23, 1985, Swiss Pat. Document No. 660,448, dated Apr. 30, 1987, and U.K. Pat. Application No. 2,223,931, dated Apr. 25, 1990, all illustrate other drink holders. All three examples have open frame receptacles, and attachment devices different from that of the present invention.

None of the above inventions and patents, taken either singly or in combination, is seen to describe the instant invention as claimed.

SUMMARY OF THE INVENTION

The present invention comprises a drink holder for quickly removable attachment to lawn furniture or the like. This device enables a user to have a convenient place to set a drink, such as a glass, cup, or can, which is close at hand, yet removed from being easily knocked over. Attachment to lawn furniture addresses this objection.

Prior art drink holders discussed above are generally designed to be effective in certain specific situations. The present invention is designed to cooperate with lawn or patio furniture which may have either tubular or square channeled frame members. The device is readily attached and removed from the furniture. Yet the precise attachment apparatus supports the drink holder in place and resists pivoting or gimballing responsive to weight imposed on the beverage container receptacle.

The beverage container receptacle is insulated to help maintain the temperature of cold or hot beverages. Preferably, the insulation is of the foam rubber type, so that beverage containers of different dimensions are accommodated by yielding of the material.

To these ends, the novel drink holder has an insulated receptacle for receiving a beverage container, and a clamp for engaging the frame member of lawn or patio furniture. The clamp has foam rubber cushions for conforming to the configuration of different types of frame members, and for improving frictional grip thereon. Straps having hook and loop fastener reinforce the grip of the clamp.

In alternative embodiments, the clamp may have a lower jaw movable in steps, or may have a spring loaded pivoting lower jaw.

Accordingly, it is a principal object of the invention to provide a drink holder which is readily attachable to lawn furniture having frame members of different configurations.

It is another object of the invention to provide a drink container receptacle which is insulated and which accommodates containers of different dimensions.

It is a further object of the invention to provide a clamp for attachment to lawn furniture.

Still another object of the invention is to provide secure attachment of the drink holder which will resist pivoting or gimballing when the weight of a drink is borne by the receptacle.

An additional object of the invention is that the clamp automatically grasp the lawn furniture.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
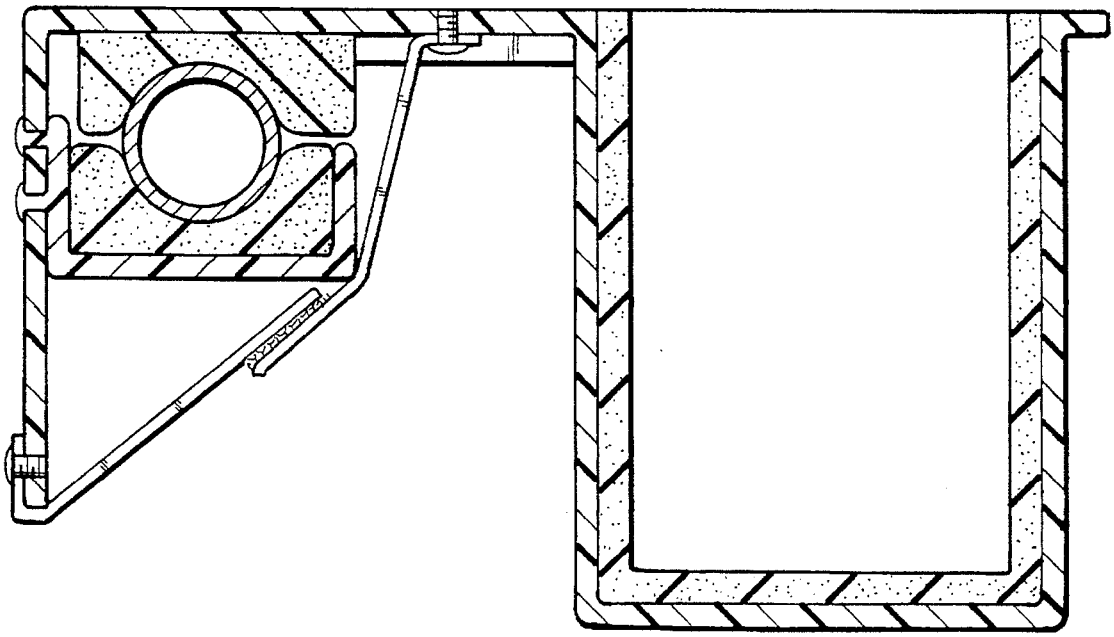
FIG. 1 is a side cross sectional view of a first embodiment of the invention, wherein the novel drink holder has an adjustably positioned clamp jaw positioned around a tube.

Turning now to FIG. 1 of the drawings, a first embodiment of novel drink holder 10 includes a receptacle 12 and a clamp 14. Receptacle 12 generally comprises a cylindrical lateral wall 16 and a bottom wall 18, for surrounding and holding a beverage container (not shown), such as a metal can, ceramic cup, or the like, placed therein. The precise configuration of receptacle 12 is not critical, and walls 16 and 18 may be perforated or otherwise partially open.

A liner 20 fabricated from insulating material helps to maintain the temperature of the beverage, whether hot or cold. Preferably, liner 20 is made from a resilient material, such as an expanded synthetic resin, for example, material popularly known as "foam rubber". This type of material not only insulates, but also yields to accommodate containers of different dimensions, and frictionally grips the container.

A laterally extending arm 22 projects horizontally from receptacle 12, and terminates in a vertical extension 24. Arm 22 supports the weight of receptacle 12 and its beverage when clamp 14 grasps an environmental object.

Clamp 14 encircles the supporting environmental object, in this case a tubular frame member 26 of a lawn chair or the like (not shown). In the embodiment of FIG. 1, clamp 14 includes a clamp member or lower jaw 28 which surrounds frame member 26 by the following arrangement.

Clamp member 28 is fastened to vertical extension 24. Adhered to the underside of arm 22 and to the top of clamp member 28 are opposed resilient cushions 30. Cushions 30 are preferably formed from an expanded synthetic resin in the manner of insulating liner 20. Cushions 30 conform to the shape of member 26 or other supporting environmental object as clamp 14 is closed therearound.

Figure 2:
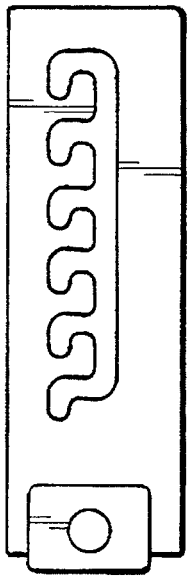
FIG. 2 is a side elevational detail view taken from the left of FIG. 1, showing slots enabling adjustment of the clamp jaw. The plurality of slots has been omitted from FIG. 1 for clarity, and is properly shown in FIG. 2.
Figure 3:
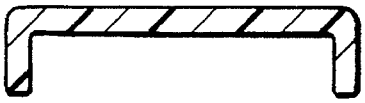
FIG. 3 is a cross sectional detail view of the arm projecting from the receptacle of FIG. 1.

Resilience of expanded resin is advantageous since clamp member 28 is adjusted in steps. Clamp member 28 includes protuberances 32 having enlarged heads 34, which are received in corresponding adjustment slots 36 formed in vertical extension 24. As clearly shown in FIG. 2, slots 36 have locking and communication portions 38 and 40, respectively. Clamp member 28 is manipulated so that protuberances 32 are slidably moved through communication portions 40 of slots 36, and adjustment is achieved by inserting protuberances 36 selectively into desired adjustment slots 36. Protuberances interlock with slots 36 when they occupy locking portions 38.

Returning to FIG. 1, despite abutment of vertical member 42 of clamp member 28 with vertical extension 24 of arm 22, sufficient weight contained within receptacle 12 may cause drink holder 10 to gimbal or pivot about supporting lawn chair frame member 26. Additional force maintaining the grip of clamp 14 is provided by elongated, flexible straps 44. Straps 44 are anchored permanently to drink holder 10 at one end, and are mutually attached by hook and loop fastener 46 at the other end.

Figure 4:
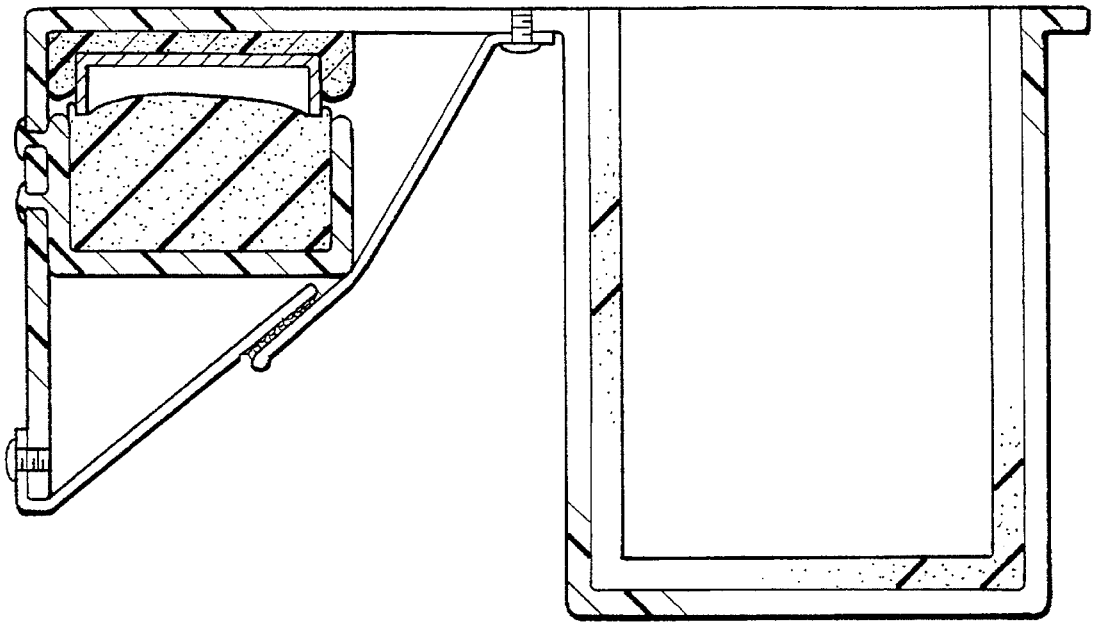
FIG. 4 is a view substantially identical to FIG. 1, but showing the clamp grasping a square channeled frame member instead of the tube illustrated in FIG. 1.

FIG. 4 illustrates engagement by clamp 14 of a lawn chair frame member of different configuration. In this view, frame member 48 has the squared or perpendicular surfaces of a partial parallelepiped. Frame member 48 is equally effectively grasped by cushions 30. Drink holder 10 may thus be employed with both types of furniture frame members.

Figure 5:
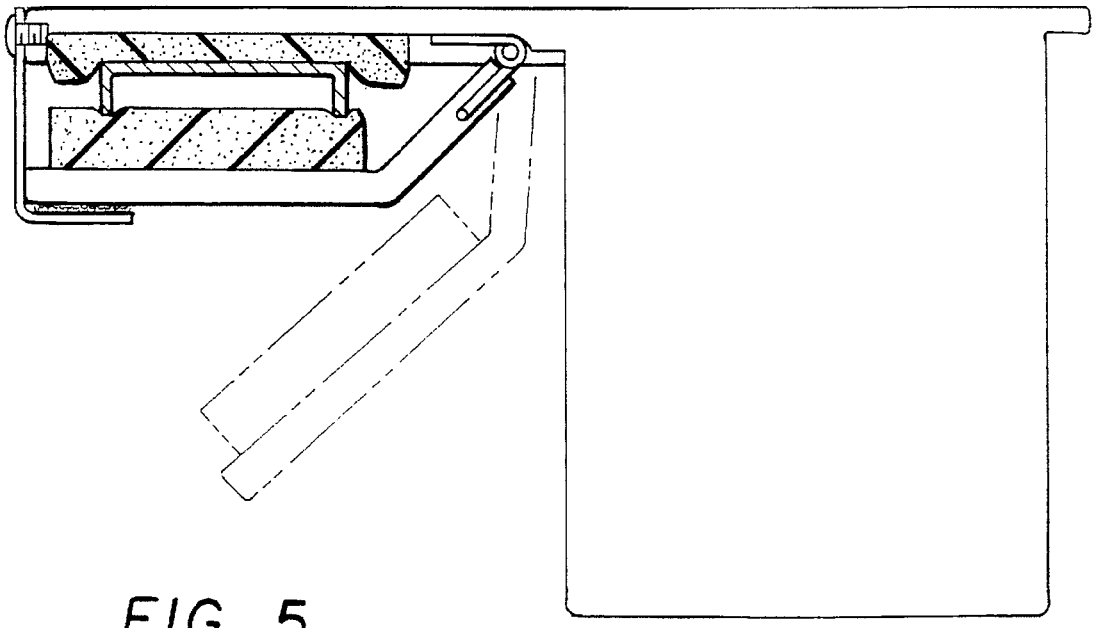
FIG. 5 is a side cross sectional detail view of a second embodiment of the invention, wherein the clamp comprises a spring loaded, pivoting lower jaw.

Turning to FIG. 5, an alternative embodiment of clamp 14 is illustrated. In this embodiment, clamp 14 also partially encircles a frame member (member 48 is illustrated, but the same effect would occur with member 26). In the alternative embodiment depicted in this Figure, clamp or encircling member 14 includes a jaw 50 pivotally mounted to drink holder 10 at a rod 52. An open position is indicated in broken lines. A spring 54 urging jaw 50 towards abutment with arm 22 is supported on rod 52.

Figure 6:
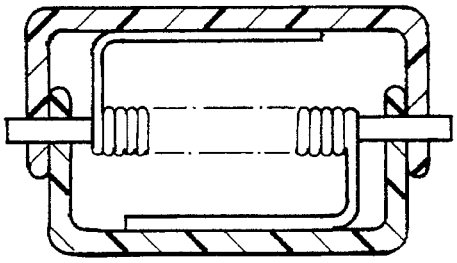
FIG. 6 is a partly cross sectional detail view of the spring of FIG. 5.

Cooperation and interfitting of arm 22, jaw 50, rod 52, and spring 54 is better seen in the detail of FIG. 6. Ends 56,58 of spring 54 may be embedded in arm 22 or jaw 50, or stapled thereto, or may act on stops (not shown) projecting from arm 22 and jaw 50. The precise method of securement is not important, so long as the goal of urging jaw 50 into the closed position abutting arm 22 is achieved, so that drink holder 10 automatically grasps member 26 or 48, or other supporting environmental object (not shown).

In FIG. 5, it will be seen that there is only one strap 44. In this instance, corresponding patches of hook and loop material 46 are disposed upon strap 44 and also upon the bottom of jaw 50. It would be possible to employ either one strap 44 or two such straps in the embodiments of FIG. 1 and FIG. 5 to equal effect. Two straps 44 are shown in FIG. 1 since it is felt that access to the point of attachment 60 is superior in the location shown.

Straps 44 may be secured to their respective permanent anchorings by screws 62 or any suitable method.

It is to be understood that the present invention is not limited to the sole embodiment described above, but encompasses any and all embodiments within the scope of the following claims.

I claim:

1. A drink holder comprising:

a receptacle for holding a beverage container, said receptacle including a liner fabricated from insulating material;

a laterally extending support arm projecting from said receptacle, said laterally extending support arm including a vertical extension; and encircling means for grasping an environmental object, said encircling means having a clamp member fastened to said vertical extension, said clamp member including opposed resilient cushions for enabling said means for grasping to conform to the shape of the environmental object, said clamp member including protuberances having enlarged heads, and said vertical extension including means defining a plurality of adjustment slots for receiving said protuberances, said protuberances slidably movable within said slots and interlocked therein, whereby said clamp member is adjusted by inserting said protuberances selectively into said adjustment slots.

2. The drink holder according to claim 1, said encircling means including an elongated, flexible strap having a proximal end and a distal end bearing hook and loop fastener, said strap anchored permanently to said drink holder at said proximal end and removably attachable at said distal end to corresponding hook and loop material.

3. A drink holder comprising:

a receptacle for holding a beverage container, said receptacle including a liner fabricated from insulating material;

a laterally extending support arm projecting from said receptacle, said laterally extending support arm having a vertical extension; and encircling means for grasping an environmental object, including:

opposed resilient cushions for enabling said means for grasping to conform to the shape of the environmental object, at least one elongated, flexible strap having at least one elongated, flexible strap having a proximal end and a distal end bearing hook and loop fastener, said strap anchored permanently to said drink holder at said proximal end and removably attachable at said distal end to corresponding hook and loop material, said strap anchored permanently to said drink holder at said proximal end and removably attachable to said drink holder at said distal end, and a clamp member fastened to said vertical extension., said clamp member including protuberances having enlarged heads, and said vertical extension including means defining a plurality of adjustment slots for receiving said protuberances, said protuberances slidably movable within said slots and interlocked, whereby said clamp member is adjusted by inserting said protuberances selectively into said adjustment slots.

* * * * *